US007071604B2

(12) United States Patent
Dayton, Jr.

(10) Patent No.: US 7,071,604 B2
(45) Date of Patent: Jul. 4, 2006

(54) ELECTRON SOURCE

(75) Inventor: James A. Dayton, Jr., Cleveland, OH (US)

(73) Assignee: GENVAC Aerospace Corporation, Richmond Heights, OH (US)

( * ) Notice: Subject to any disclaimer, the term of this patent is extended or adjusted under 35 U.S.C. 154(b) by 13 days.

(21) Appl. No.: 10/367,514

(22) Filed: Feb. 13, 2003

(65) Prior Publication Data

US 2003/0151341 A1 Aug. 14, 2003

Related U.S. Application Data

(66) Substitute for application No. 60/356,608, filed on Feb. 13, 2002.

(51) Int. Cl.
*H01J 43/00* (2006.01)
*H01J 1/00* (2006.01)

(52) U.S. Cl. ..... 313/311; 313/532; 313/460; 313/495; 250/399

(58) Field of Classification Search ..... 313/311, 313/293, 103 R, 103 CM, 377, 532, 534
See application file for complete search history.

(56) References Cited

U.S. PATENT DOCUMENTS 2,172,155 A * 9/1939 Snyder ..... 313/105 R
2,217,860 A * 10/1940 Farnsworth ..... 327/573
2,433,724 A * 12/1947 Wolfgang ..... 313/536
3,716,738 A * 2/1973 Beeli ..... 313/377
3,939,374 A * 2/1976 Schagen et al. ..... 313/534
5,944,573 A 8/1999 Mearini et al.
6,244,212 B1 6/2001 Takacs et al.
6,301,333 B1 10/2001 Mearini et al.
6,475,355 B1 11/2002 Mearini et al.
6,521,149 B1 2/2003 Mearini et al.
2002/0012746 A1 1/2002 Mearini et al.
2002/0125827 A1 9/2002 Mearini et al.

OTHER PUBLICATIONS

Company Commercialization Report, Dayton et al., "Inexpensive High Quality Electron Sources." pp. 3-21. Appln. No. 70266SO2-1, Jan. 15, 2002.
Zorman et al., "An In-situ Annealing Study of Hydrogen-Containing Adsorbates on Polycrystalline Diamond Surfaces Using Elastic Recoil Detection," Diam. and Rel. Mat. 9, 1518-1523 (2000).

(Continued)

*Primary Examiner*—Ashok Patel
(74) *Attorney, Agent, or Firm*—Fay, Sharpe, Fagan, Minnich & McKee, LLP

(57) ABSTRACT

An electron gun (10) includes an electron multiplier (22, 22', 22", 110) has a receiving end (50, 50', 50") for receiving primary electrons and an output end (54, 54', 54") that emits secondary electrons responsive to primary electrons arriving at the receiving end. An electron emitter (20, 20', 20", 102) is arranged at the receiving end of the electron multiplier for supplying primary electrons thereto. At least one of an electrical and a magnetic focusing component (14, 16) is arranged at the open output end of the electron multiplier for focusing the secondary electrons to define an electron beam. In a suitable embodiment, the electron multiplier includes a generally conical substrate (74, 90) and an electron mirror (52, $\mathbf{52_1}$, $\mathbf{52_2}$, $\mathbf{52_3}$, $\mathbf{92_1}$, $\mathbf{92_2}$) including a high secondary electron yield film (70) disposed on an outer surface of the conical substrate.

20 Claims, 7 Drawing Sheets

OTHER PUBLICATIONS

Mearini et al., "Fabrication of an Electron Multiplier Utilizing Diamond Films," Thin Solid Films, 253(1), 151-156 (1994).

Mearini et al., "Investigation of Diamond Films for Electronic Devices," Conference Record, The 1994 Tri-Service/NASA Cathode Workshop, 135-138 (1994).

Mearini et al., "Stable Secondary Electron Emission Observations from CVD Diamonds," Appl. Phys. Lett., 65(21), 2702-2704 (1994).

Mearini et al., "Effects of Surface Treatments on secondary Electron Emission from CVD Diamond Films." Diamond Films and TEch., 5(6), 339-351 (1995).

Lamouri et al., "Electron Emission Observations from As-Grown and Vacuum-Coated Chemical Vapor Deposited Diamond," J. Vac. Sci. and Tech. B 14(3), 2046-2049, May/Jun. (1996).

Mearini et al., "Stable Secondary Electron Emission from CVD Diamond Films Coated with Alkali-Halides," Appl. Phys. Lee., 66(2), 242-244 (1995).

Krainsky et al, "Auger Electron Spectroscopy of the Hydrogen Terminated Chemical Vapor deposited Diamond Surface," Appl. Phys. Lett., 68(14), 2017-2019, Apr. (1996).

* cited by examiner

ELECTRON SOURCE

This application claims the benefit of U.S. Provisional Application No. 60/356,608, filed Feb. 13, 2002.

BACKGROUND

The present invention relates to the radiation generation arts. It particularly relates to high brightness electron sources for producing linear hollow electron beams, spinning hollow electron beams, solid electron beams, and the like, and will be described with particular reference thereto. However, the invention will also find application in other radiation sources.

High brightness electron beams having selected spatial and electrical characteristics are used in a wide range of applications. A gyrotron, for instance, employs an electron gun that produces a spinning hollow electron beam. Klystrons operate with linear hollow electron beams. Other applications call for a high brightness solid electron beam.

Heretofore, injection electron guns have generally been used for such applications. These guns include a thermionic cathode, typically in the form of a porous tungsten pellet that is impregnated with barium oxide and other substances. Upon heating, barium migrates to the cathode surface and reduces the work function of the cathode surface and thus facilitates efficient thermionic emission.

However, a problem arises because barium is lost to the vacuum during operation, which limits operating life of the cathode and can produce barium contamination elsewhere in the vacuum system. Moreover, barium loss increases with cathode temperature, which limits operating temperature and hence brightness of the electron gun. Cathode heating also can produce undesired outgassing and heating of nearby components.

The present invention contemplates an improved apparatus and method.

SUMMARY

According to one embodiment, an electron source is disclosed. A substantially conical electron multiplier has an apex region and an open output end. An electron emitter is arranged to input electrons into the apex region of the substantially conical electron multiplier.

According to another embodiment, an electron gun is disclosed. An electron multiplier has a receiving end for receiving primary electrons and an output end that emits secondary electrons responsive to primary electrons arriving at the receiving end. An electron emitter is arranged at the receiving end of the electron multiplier for supplying primary electrons thereto. At least one of an electrical and a magnetic focusing component is arranged at the open output end of the electron multiplier for focusing the secondary electrons to define an electron beam.

According to yet another embodiment, a method is provided for producing an electron beam. First electrons are generated at an apex region. Electrons are repeatedly accelerated toward secondary electron-generating impacts with one or more high secondary electron yield surfaces arranged at increasing distances away from the apex region. The repeated accelerating drives electrons away from the apex region between successive electron-generating impacts. The repeated accelerating terminates when the electrons reach an output region. Electrons are electrically or magnetically biased in the output region to form an electron beam.

Numerous advantages and benefits of the present invention will become apparent to those of ordinary skill in the art upon reading the following detailed description of the preferred embodiments.

BRIEF DESCRIPTION OF THE DRAWINGS

The invention may take form in various components and arrangements of components, and in various process operations and arrangements of process operations. The drawings are only for the purpose of illustrating preferred embodiments and are not to be construed as limiting the invention.

DETAILED DESCRIPTION OF THE PREFERRED EMBODIMENTS

Figure 1:
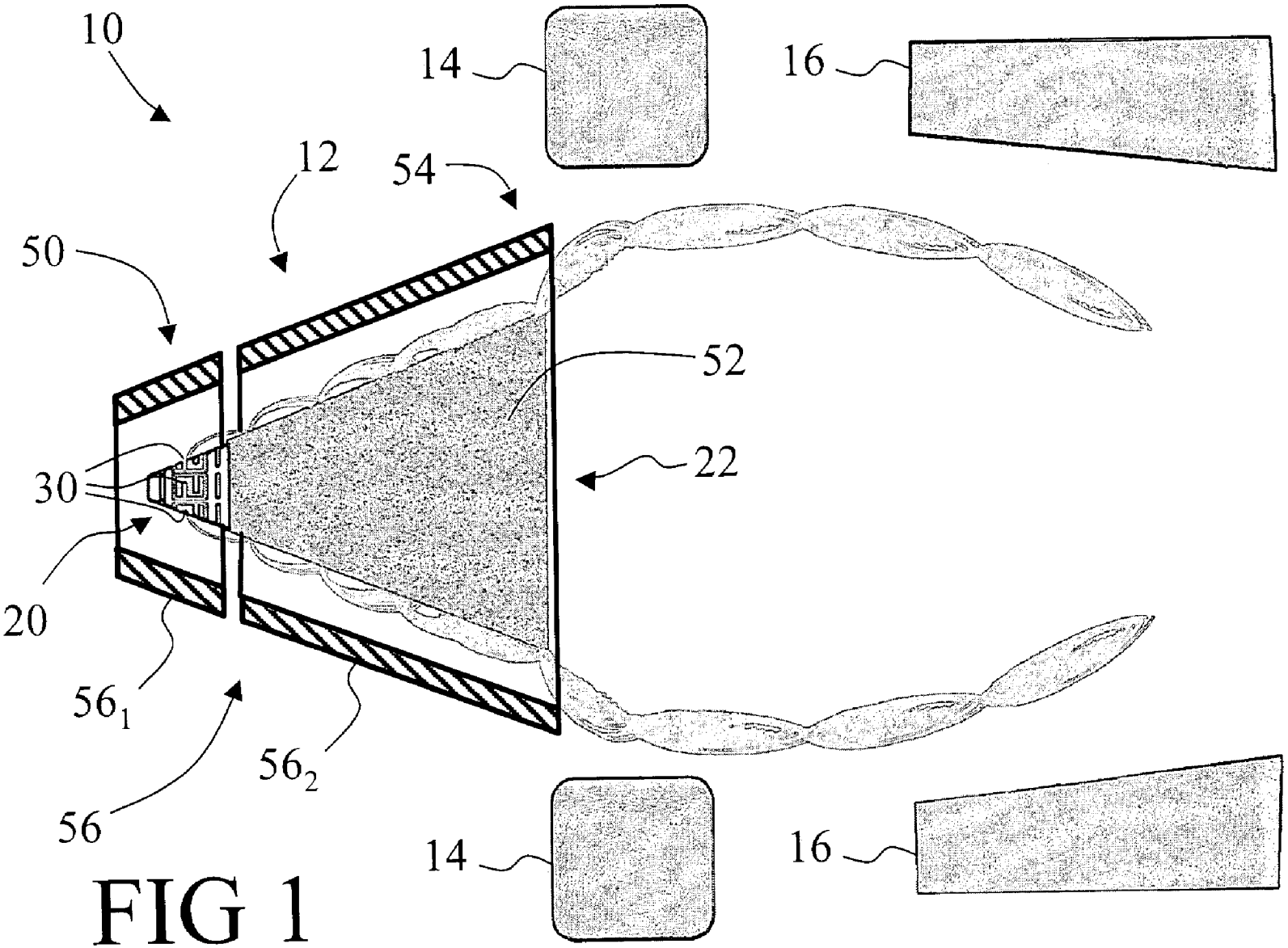
FIG. 1 shows a side view in partial section of an electron gun that produces a spinning hollow electron beam suitable for use in a gyrotron or other device.

With reference to FIG. 1, an electron gun 10 for producing a spinning hollow electron beam includes an electron source 12, modulating anodes 14, and accelerating anodes 16. The anodes 14, 16 are electrostatic focusing devices that operate in known ways to focus electrons from the electron source 12 into an electron beam. In the exemplary embodiment of FIG. 1, a spinning hollow beam is produced by introducing the beam into a magnetic field, which is not shown in the figure. Alternatively, a linear hollow beam can be produced by using a different configuration of anodes. The electron source 12 includes a primary electron emitter 20 and an electron multiplier 22.

Figure 2A:
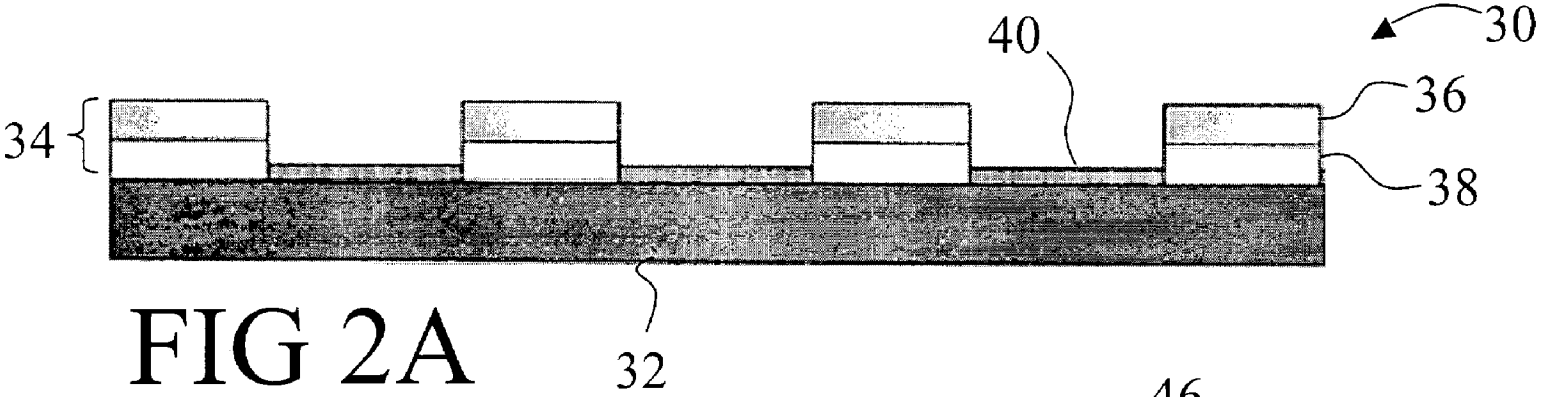
FIGS. 2A and 2B show a cross-sectional view and a perspective view, respectively, of one of the field emission arrays of the electron gun of FIG. 1.
Figure 2B:
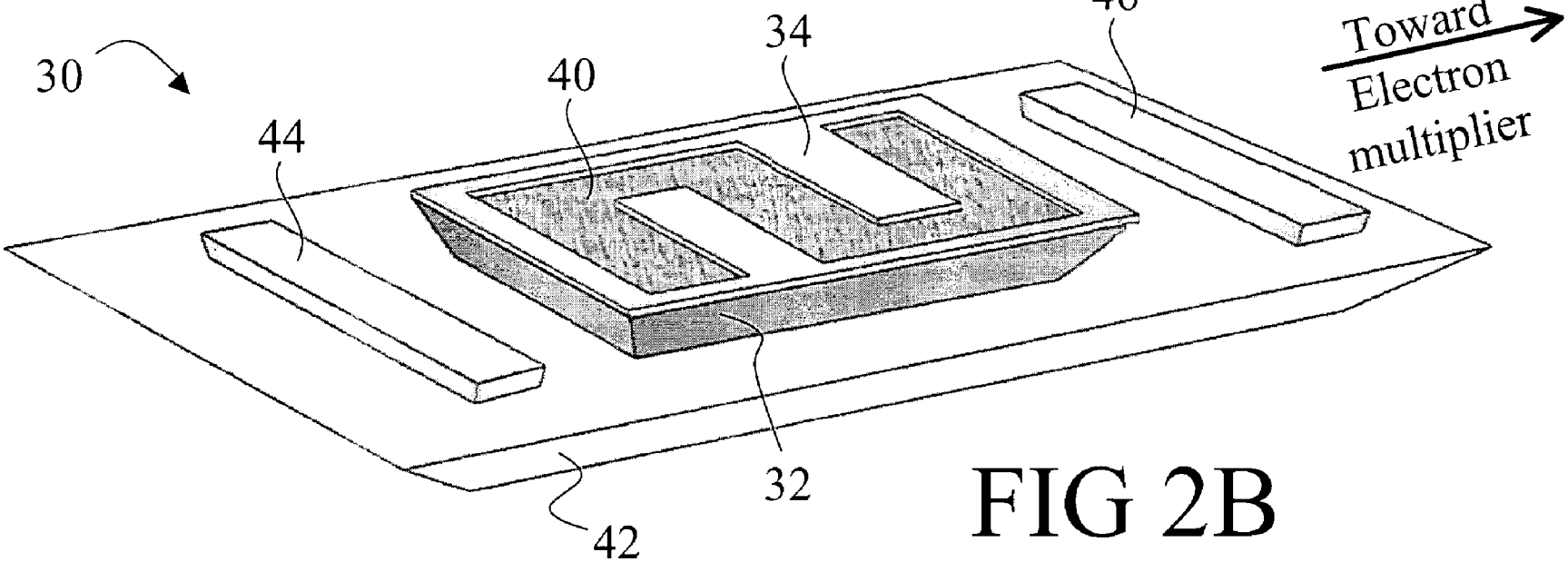

With continuing reference to FIG. 1 and additional reference to FIGS. 2A and 2B, the primary electron emitter 20 includes a plurality of field emission devices 30. In a preferred embodiment, each field emission device 30 includes a silicon substrate 32 and a lithographically patterned gate 34 including a conductive layer 36, preferably gold or molybdenum, disposed on an insulating layer 38, preferably silicon dioxide.

Within the lithographically patterned gate 34 a diamond film field emitter 40 is deposited, preferably by chemical vapor deposition. The diamond film 40 is selectively deposited by lithographic patterning or by selective chemistry in which the diamond film 40 selectively deposits on the silicon 32. A preferred method for fabricating the field emission device 30 is described in U.S. Pat. No. 5,944,573 issued to Mearini and Kusner.

Such field emission devices have been demonstrated to produce current densities above 5 amperes/$cm^2$ and to have threshold gate voltages below 0.3 volts. To generate electrons by field emission, the diamond emitter 40 is biased with respect to the gate 34. Each field emission device 30 is arranged on a sub-mount 42. Steering electrodes 44, 46 are also arranged on the sub-mount 42, including a negatively biased electrode 44 distal from the electron multiplier 22 and a positively biased electrode proximate to the electron multiplier 22. The steering electrodes produce an electric field that urges the field-emitted electrons generally toward an apex 50 of the electron multiplier 22.

The primary electron emitter 20 is exemplary only. Those skilled in the art can make modifications to the described field emission devices 30 to suit specific applications. Depending upon the fluence of primary electrons needed for a specific application, a single field emission device may be sufficient. The diamond field emitter film 40 can be replaced by a film of carbon nanotubes or other type of film that has advantageous field emission characteristics. Moreover, the field emission devices 30 can be replaced by other types of primary electron emitters, such as by one or more thermionic sources.

With particular reference to FIG. 1, primary electrons from the primary electron emitter 20 are input into the apex region 50 of the electron multiplier 22. The electron multiplier 22 is generally conical, and effects electron multiplication by repeatedly accelerating electrons toward secondary electron-generating impacts with a conical electron mirror or dynode film 52. Between impacts, the accelerating drives the multiplying electrons generally away from the apex region 50 and toward an output region 54 of the electron multiplier 22.

Electric fields for producing the repeated acceleration are generated on the electron mirror 52 and on a generally conical focusing electrode 56 (shown in section) that substantially surrounds the electron mirror 52. For some configurations of the electron multiplier 22, the focusing electrode 56 is biased negatively to help drive secondary electrons back toward the electron mirror 52 between collisions. For other configurations, the focusing electrode 56 is biased positively to help pull secondary electrons away from the electron mirror 52 between collisions. This provides an arced electron trajectory that allows substantial electron acceleration and kinetic energy gain between collisions to promote high secondary electron production. For certain configurations of the generally conical electron multiplier 22, biasing of the electron mirror 52 alone is adequate, and the focusing electrode 56 may be omitted.

In one preferred embodiment shown in FIG. 1, the focusing electrode 56 includes two focusing electrodes $\mathbf{56}_1$, $\mathbf{56}_2$. The first focusing electrode $\mathbf{56}_1$ is disposed generally around the primary electron emitter 20, and is negatively biased to drive electrons away from the emitter 20 and toward the electron multiplier 22. The second focusing electrode is disposed generally around the electron multiplier 22, and is positively biased. Moreover, more than two focusing electrodes can be employed to further tune the secondary electron trajectories.

Figure 3:
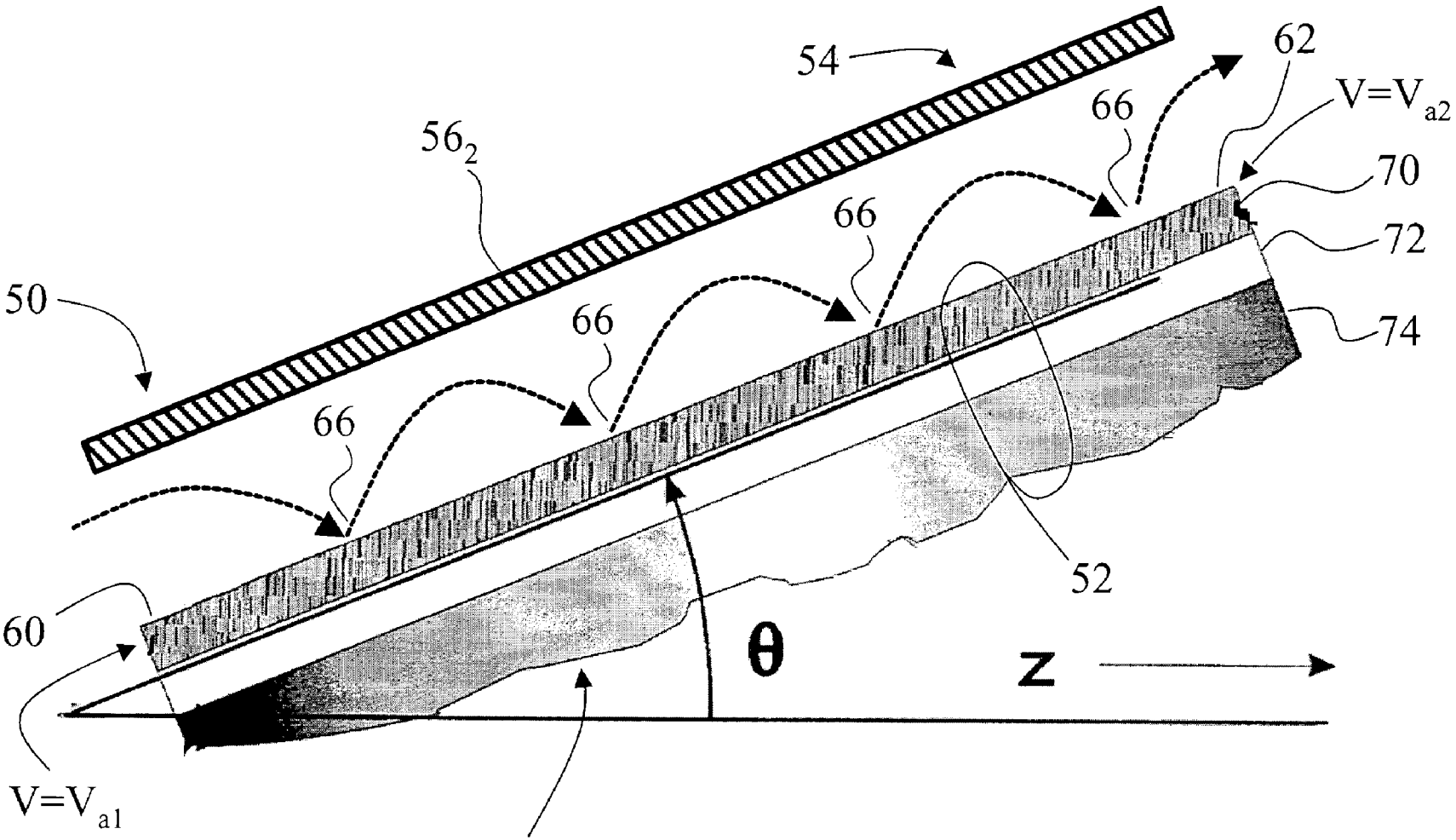
FIG. 3 shows a cross-sectional view of a portion of the generally conical secondary electron emitter of the electron gun of FIG. 1.

With continuing reference to FIG. 1 and with further reference to FIG. 3, the generally conical electron mirror 52 is preferably electrically biased to produce an electrical potential gradient in which a smallest radius point 60 in or near the apex region 50 is biased negatively respective to a largest radius point 62 in or near the output region 54. In a suitable embodiment, the smallest radius point 60 is positively biased at $V_{a1}$ with respect to ground to attract electrons from the primary source, and a much larger positive bias $V_{a2}$ is applied to the largest radius point 62.

In order to support the voltage difference $V_{a2}$–$V_{a1}$ while rapidly replenishing electrons at secondary electron impacts 66, the generally conical electron mirror 52 includes a high secondary electron yield film 70 disposed on a substantially insulating film 72 which in turn is disposed on a conductive conical substrate 74 of cone angle θ referenced to a cone axis, designated in FIG. 3 as the z-axis, of the generally conical electron mirror 52.

In a preferred embodiment, the conductive conical substrate 74 is a molybdenum substrate shaped as a frustum of a cone. The primary electron emitter 20 is conical, and is arranged in a region corresponding to a missing apex of the conical frustum, as shown in FIG. 1. Hence, the conical electron emitter 20 and the conical frustum-shaped electron mirror 52 together define a cone.

In this preferred embodiment, the high secondary electron yield film 70 is a diamond film deposited by chemical vapor deposition. The diamond film 70 is optionally doped with boron or another electrically active dopant to tailor electrical conductivity. Preferably, the diamond film 70 includes an alkali halide surface treatment to improve secondary electron yield characteristics. The insulating film 72 is suitably a boron nitride film deposited by chemical vapor deposition, or another diamond film that is deposited without electrical doping and is therefore electrically insulating. The above-described preferred embodiment is readily modified by those skilled in the art to include alternative film materials that have the required secondary yield and electrical properties.

Figure 4B:
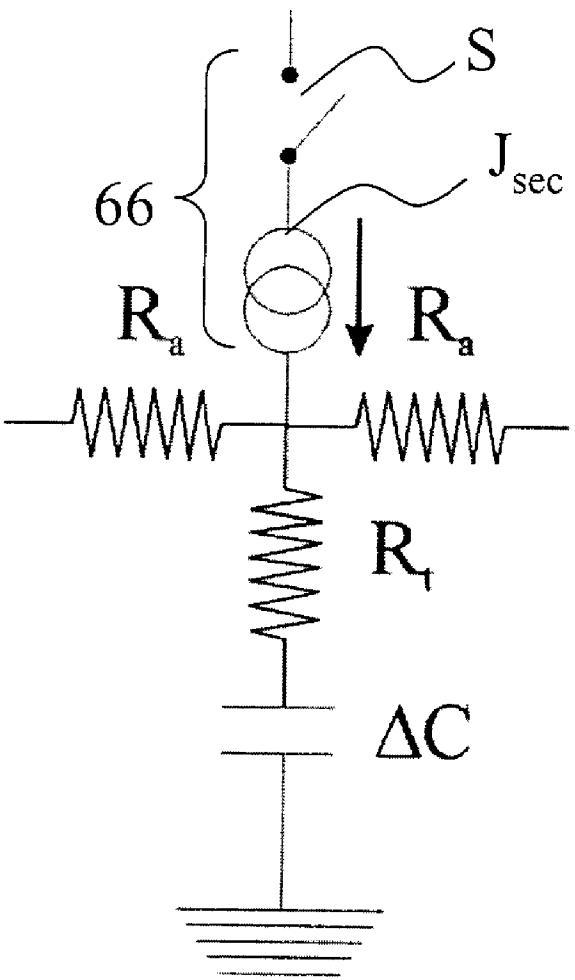
FIG. 4B shows an electrical equivalent circuit illustrating electrical behavior of the diamond film during an electron multiplication event.
Figure 4A:
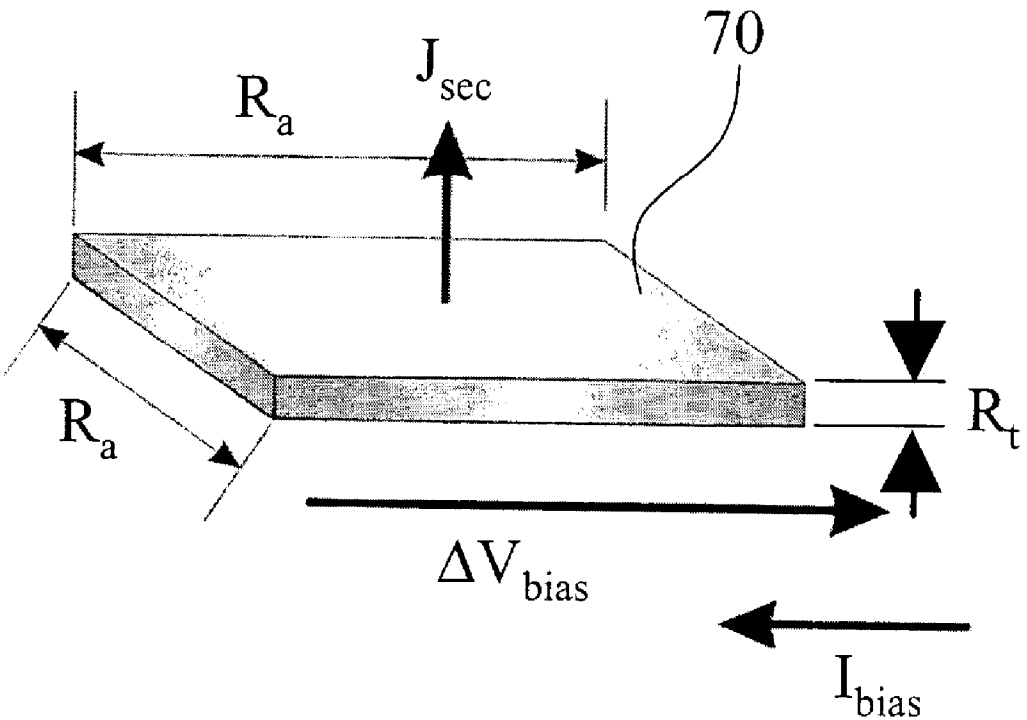
FIG. 4A diagrammatically shows electrical and structural parameters of a portion of the diamond film of the conical secondary electron emitter.

With continuing reference to FIG. 3 and with further reference to FIGS. 4A and 4B, biasing and electron replenishment in the three-material electron mirror 52 is described. The high secondary electron yield film 70 is relatively thin, and therefore exhibits substantial uniaxial anisotropy in electrical resistance. Specifically, a transverse resistance $R_t$ is much smaller than an in-plane or axial resistance $R_a$ due to a large difference in cross-sectional area along the transverse and in-plane directions. As illustrated in the electrical schematic of FIG. 4B, the small transverse resistance $R_t$ compared with the large in-plane resistance $R_a$ allows a large transient secondary electron current density $J_{sec}$ to be produced responsive to an electron impact 66. In FIG. 4B, the large transient secondary electron current is represented by a switch S and a current generator $J_{sec}$.

The large transient secondary current $J_{sec}$ is supported by capacitive discharge of a capacitor ΔC representing local capacitance of the insulator film 72. Since the charge in a capacitor is proportional to the voltage squared, the charge available locally increases with voltage and is largest near the output end point 62, which advantageously is the point at which the largest secondary electron fluence is drawn.

It will be appreciated that such capacitive discharge operation is not indefinitely sustainable. However, it supplies copious transient current to support large secondary electron yields. The capacitance is subsequently recharged through the conducting substrate.

The potential gradient $V_{bias}$ along the secondary emitting surface is produced by the electrical bias $V_{a2}$–$V_{a1}$, which produces a lateral current $I_{bias}$ that is relatively small due the large in-plane resistance $R_a$ of the diamond film 70.

For the electron gun 10 of FIG. 1 to operate as a high-brightness gun, the electron source 12 should produce a high fluence of output electrons. The electron fluence is a function of the cumulative secondary electron yield of the electron multiplier 22. Those skilled in the art know that electron multipliers are regularly used in signal detection applications. For example, photomultiplier tubes are well known in the art. However, such electron multiplier-based signal detectors are unable to support high current densities, and indeed the electron multiplication component of a photomultiplier tube is known to catastrophically fail in response to overload levels of electron input.

In contrast, the electron multiplier 22 readily supports high current densities. One reason for this is that, as the electron fluence increases along the z-axis from the input apex region 50 to the output region 54, the annular radius and area of the electron mirror 52 increases due to its conical shape. It is contemplated for the conical electron mirror 52 can be as small as about one millimeter or less at the apex end 50, and as large as three centimeters to ten centimeters or larger at the output end 54.

The electron multiplier 22 also has good thermal heat sinking characteristics. The molybdenum or other conductive conical substrate 74 provides good thermal conductivity, and heat sinking is further improved by the conical shape of the electron mirror 52 which distributes heat at the output end 54, where the highest electron fluence exists, across a large area. Effective heat sinking of the electron mirror 52 obviates thermal limitations in operating the electron multiplier-based electron gun 10 at high brightnesses.

High brightness operation is further supported by the preferred use of diamond as the material for the high electron yield film 70. Empirical measurements show that chemically vapor deposited diamond on molybdenum has secondary electron yields in excess of 10 for impacting electron energies of about 1 kV or higher. With an alkali halide surface treatment, such as by coating with a 10 nm thick CsI surface layer, the secondary electron yield can be raised to about 25 at 1 kV, and about 50 at 3 kV. High secondary yield values advantageously result in lower electron fluences at the last multiplication stage that produces the output beam. This corresponds to a reduced maximum fluence of electrons impacting the electron mirror 52 at the largest radius point 62.

For high brightness operation, the positive bias Va, optionally modified by a voltage applied to the focusing electrode 56, should be sufficiently large to accelerate electrons to high energies prior to impact to provide high secondary electron yields. Preferably, the electrons are accelerated to about 1 kV or higher between impacts. However, lower electron accelerations between imp-acts can be compensated by increasing a total number of multiplication stages.

The three-material electron mirror 52 supports a large electrical potential gradient between the apex point 60 and the output point 62 due to high in-plane or axial resistance $R_a$. However, the magnitude of supportable voltage $V_{a2}-V_{a1}$ can be reduced by lower in-plane $R_a$ resistances which can result from electrically active impurities in the diamond film 70, leakage currents through the insulator film 72, and other material flaws. Certain chemical vapor deposition systems may be unable to produce diamond films with a sufficiently high in-plane resistance $R_a$ to support a large voltage $V_{a2}-V_{a1}$ using the electron multiplier embodiment of FIG. 1.

Figure 5:
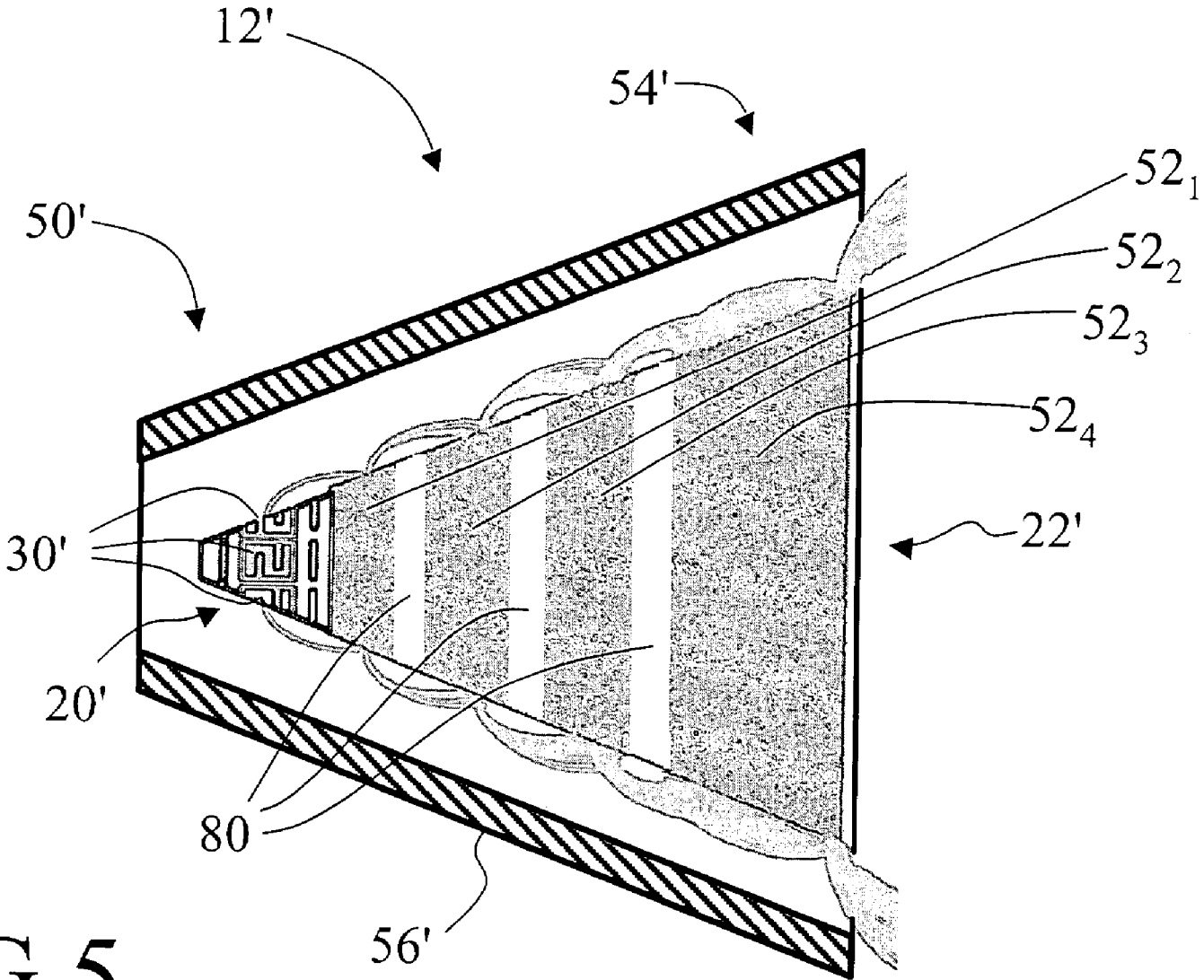
FIG. 5 shows a side view in partial section of an alternate embodiment of the generally conical secondary electron emitter, in which the diamond surface is patterned to define electrically isolated annular dynodes of successively increasing radius.

With reference to FIG. 5, another preferred electron source 12' is suitable for replacing the electron source 12 in the electron gun 10 of FIG. 1. The electron source 12' is generally similar to the electron source 12, and components that are substantially similar in the two electron sources 12, 12' are labeled with corresponding primed reference numbers. For example a primary electron emitter 20' is substantially similar to the primary electron emitter 20, including a plurality of field emission devices 30' that are substantially similar to the field emission devices 30, and a generally conical focusing electrode 56' (shown in section in FIG. 5) is substantially similar to the generally conical focusing electrode 56, and so forth.

In the electron source 12', a single encompassing generally conical focusing electrode 56' is employed. However, two or more focusing electrodes, for example similar to the two focusing electrodes $\mathbf{56}_1$, $\mathbf{56}_2$ of the electron source 12 of FIG. 1, can similarly be used to tailor electric fields in the electron source 12'.

The electron source 12' further differs from the electron source 12 in that the continuous electron mirror 52 of the electron source 12 is replaced in the electron source 12' by a succession of generally annular electron mirror or dynode rings $\mathbf{52}_1$, $\mathbf{52}_2$, $\mathbf{52}_3$, $\mathbf{52}_4$ that increase in annular radius with distance away from the apex region 50' and are separated by electrically insulating gaps 80 in which at least the diamond film 70 is omitted.

The annular mirror rings $\mathbf{52}_1$, $\mathbf{52}_2$, $\mathbf{52}_3$, $\mathbf{52}_4$ act as individual dynodes that are increasingly positively biased with increasing distance from the apex region 50'. In one suitable biasing arrangement, the mirror rings $\mathbf{52}_1$, $\mathbf{52}_2$, $\mathbf{52}_3$, $\mathbf{52}_4$ are biased at $0.25V_a$, $0.50V_a$, $0.75V_a$, and $V_a$, respectively. Moreover, the diamond film of the dynodes $\mathbf{52}_1$, $\mathbf{52}_2$, $\mathbf{52}_3$, $\mathbf{52}_4$ can be electrically conductive since an electric potential is not maintained across a continuous diamond film. The three-material electron mirror structure of FIG. 3 is suitably replaced by a two-material structure, in which the mirror rings are formed as electrically conductive diamond films that are deposited on an electrically insulating but thermally conductive conical substrate. Alternately, the mirror rings are deposited on metal conical segments that are electrically isolated from one another and relatively arranged to define an expanding cone. Preferably, the metal segments are molybdenum segments.

Figure 6:
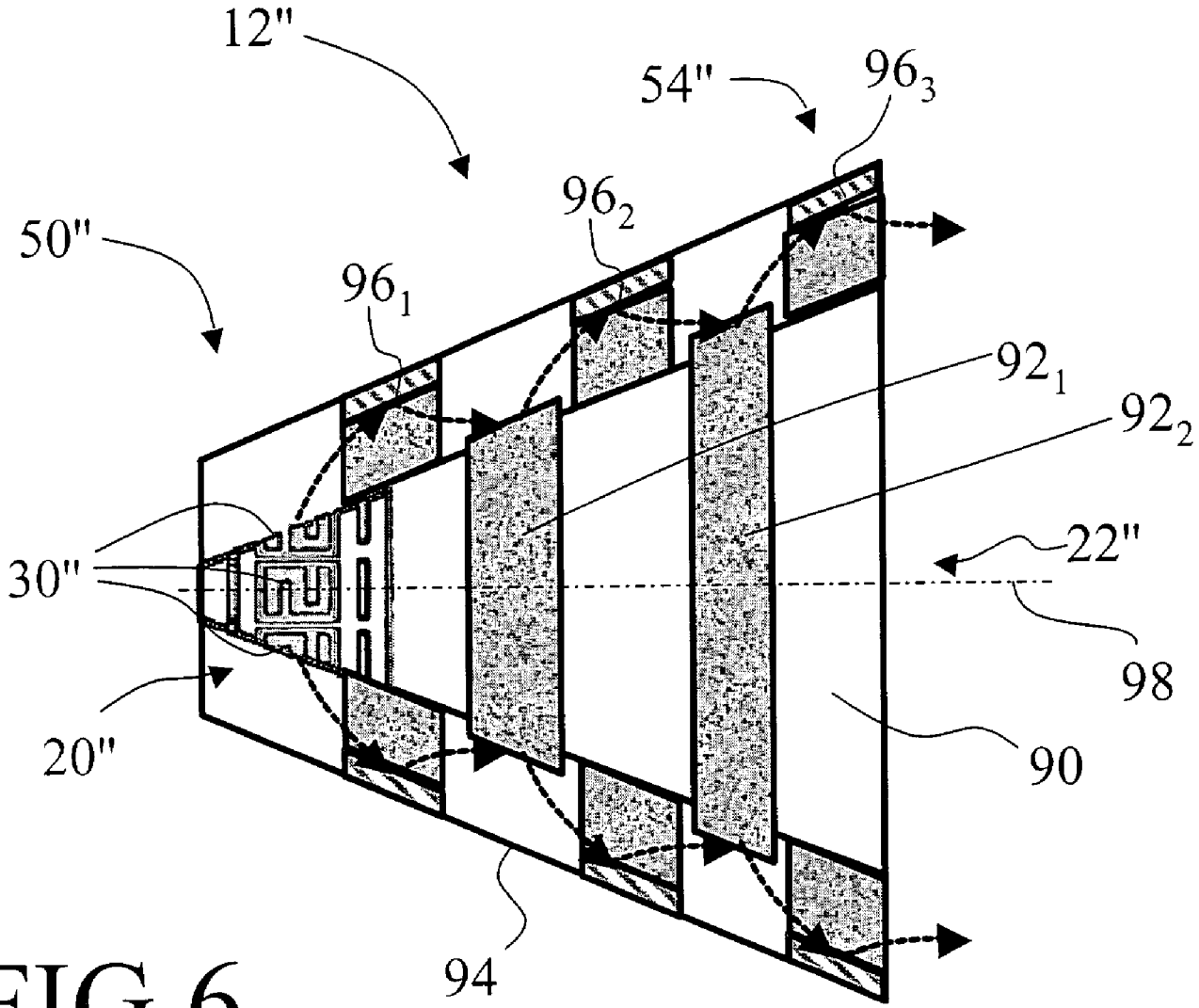
FIG. 6 shows a side view in partial section of another alternate embodiment of the generally conical secondary electron emitter, including two facing sets of annular diamond film dynodes.

With reference to FIG. 6, yet another preferred electron source 12" that is suitable for replacing the electron source 12 in the electron gun 10 of FIG. 1 is described. The electron source 12" includes a primary electron emitter 20" that is substantially similar to the primary electron emitter 20, including a plurality of field emission devices 30" that are substantially similar to the field emission devices 30 of FIGS. 1, 2A, and 2B. The electron source 12" also includes an electron multiplier 22" that has a generally conical shape defining an apex end 50" that receives input primary electrons and an output end 54".

The electron multiplier 22" is differently configured, however. An inner conical substrate 90 supports a plurality of inner dynodes $\mathbf{92}_1$, $\mathbf{92}_2$ that are similar to the dynodes $\mathbf{52}_1$, $\mathbf{52}_2$, $\mathbf{52}_3$, $\mathbf{52}_4$ of the electron multiplier 22' of FIG. 5. That is, the inner dynodes $\mathbf{92}_1$, $\mathbf{92}_2$ are generally annular electron mirrors arranged on the inner conical substrate 90, which are electrically isolated from one another, have increasing annular radius with distance from the apex region 50", and have an increasingly positive applied biased with increasing distance from the apex region 50".

The electron multiplier 22" also includes an outer conical substrate 94 that supports a plurality of outer dynodes $\mathbf{96}_1$, $\mathbf{96}_2$, $\mathbf{96}_3$ (shown in section in FIG. 6) on an inner surface of the outer conical substrate 94. The outer dynodes $\mathbf{96}_1$, $\mathbf{96}_2$, $\mathbf{96}_3$ are generally annular electron mirrors arranged on the outer conical substrate 94, which are electrically isolated from one another, have increasing annular radius with distance from the apex region 50", and have an increasingly positive applied biased with increasing distance from the apex region 50".

The outer dynodes $\mathbf{96}_1$, $\mathbf{96}_2$, $\mathbf{96}_3$ collectively generally face the inner dynodes $\mathbf{92}_1$, $\mathbf{92}_2$. However, the outer dynodes 96 and the inner dynodes $\mathbf{92}_1$, $\mathbf{92}_2$ are preferably offset along a cone axis 98 respective to the outer dynodes $\mathbf{96}_1$, $\mathbf{96}_2$, $\mathbf{96}_3$. Moreover, the biasing of the inner and outer dynodes are interrelated in that the dynodes $\mathbf{92}_1$, $\mathbf{92}_2$, $\mathbf{96}_1$, $\mathbf{96}_2$, $\mathbf{96}_3$ are increasingly positively biased with increasing distance from the apex region 50" along the conical axis 98.

For instance, a suitable biasing arrangement for the exemplary five dynodes $\mathbf{92}_1$, $\mathbf{92}_2$, $\mathbf{96}_1$, $\mathbf{96}_2$, $\mathbf{96}_3$ shown in FIG. 6 is: outer dynode $\mathbf{96}_1$ biased at $0.2V_a$; inner dynode $\mathbf{92}_1$ biased at $0.4V_a$; outer dynode $\mathbf{96}_2$ biased at $0.6V_a$; inner dynode $\mathbf{92}_2$ biased at $0.8V_a$; and outer dynode $\mathbf{96}_3$ biased at $V_a$. Secondary electrons are accelerated to successively collide with the five dynodes $\mathbf{92}_1$, $\mathbf{92}_2$, $\mathbf{96}_1$, $\mathbf{96}_2$, $\mathbf{96}_3$ along the following path: first collision at outer dynode $\mathbf{96}_1$; second collision at inner dynode $\mathbf{92}_1$; third collision at outer dynode $\mathbf{96}_2$; fourth collision at inner dynode $\mathbf{92}_2$; and fifth collision at outer dynode $\mathbf{96}_3$. Exemplary electron paths are shown by dotted arrows in FIG. 6.

The inner and outer generally conical substrates 90, 94 can be either electrically conductive or electrically insulating. If electrically insulating substrates are used, then a two-material system including a diamond or other high secondary electron yield material deposited on the insulating substrate is suitable. If electrically conductive substrates are used, then a diamond or other high secondary electron yield material is deposited on electrically conductive substrates that are electrically isolated from one another along the conical surfaces. In either case, the substrates 90, 94 should be thermally conductive to promote heat sinking.

The aforementioned electron source embodiments 12, 12', 12" are suitable for use in the spinning hollow beam electron gun 10 shown in FIG. 1. These electron sources 12, 12', 12" are also suitable for use in a linear hollow beam electron gun in which a suitable set of anodes provides linear acceleration of electrons.

Figure 7B:
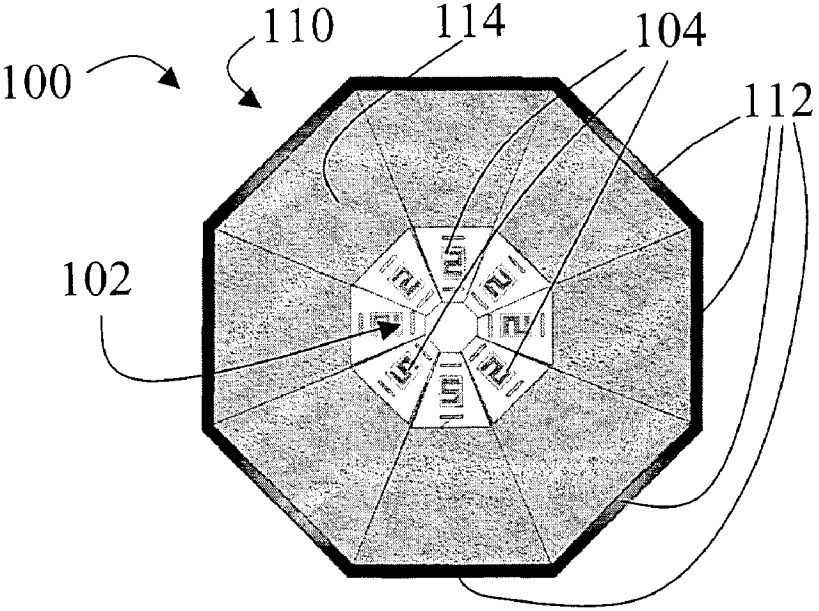
FIGS. 7A, 7B, and 7C show perspective, front, and side views, respectively, of an electron source for producing a solid electron beam.
Figure 7A:
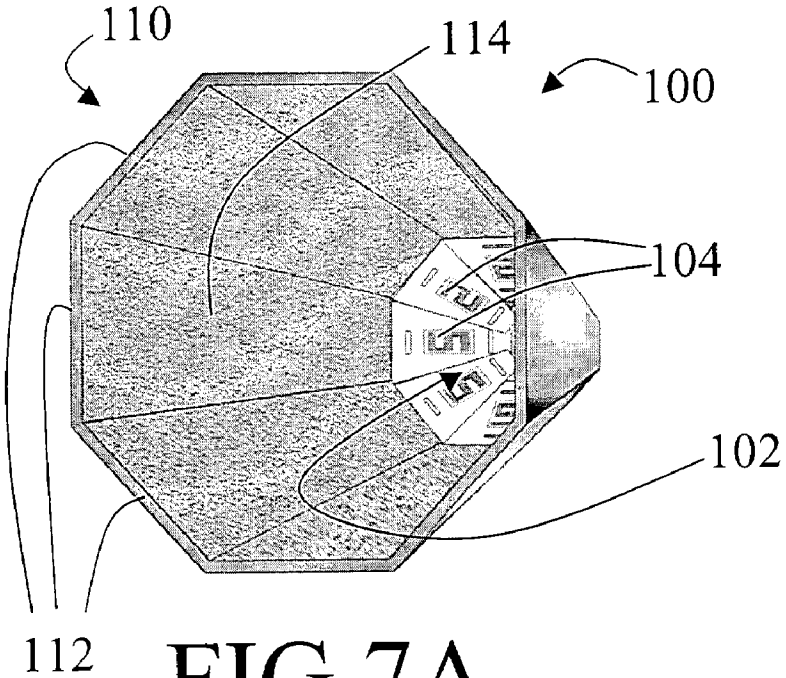
Figure 7C:
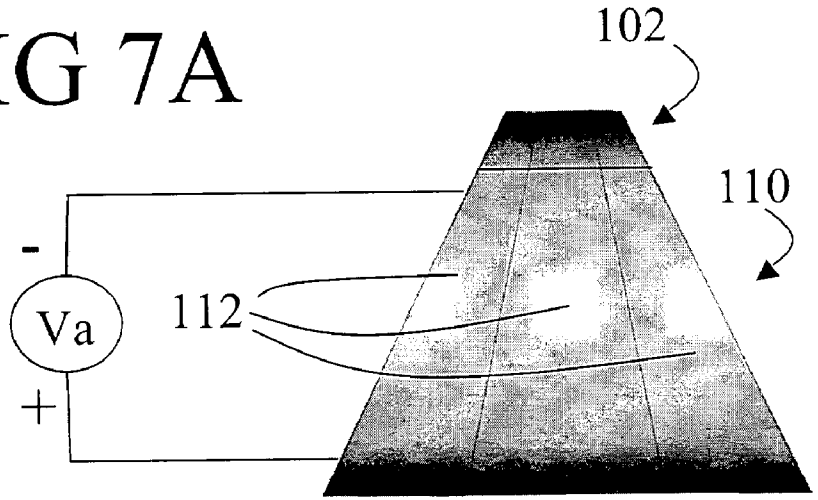

With reference to FIGS. 7A–7C, yet another electron source 100 is described, which is suitable for use in an electron gun designed to produce a solid, rather than hollow, electron beam. A primary electron emitter 102 includes a plurality of field emission devices 104 that are substantially similar to the field emission devices 30 of FIGS. 1, 2A, and 2B. The electron emitter 102 is arranged in an apex region of a generally conical electron multiplier 110 constructed from a plurality of joined planar trapezoidal pieces 112. An electron mirror 114 is disposed on interior surfaces of the generally conical electron multiplier 110.

In a preferred embodiment, the electron mirror 114 includes a diamond film deposited by chemical vapor deposition. Since achieving uniform film deposition within a generally conical structure is difficult, the planar trapezoidal pieces 112 are preferably first coated by chemical vapor deposition to form the electron mirror 114, and then joined to assemble the generally conical electron multiplier 110. The trapezoidal pieces 112 should be thermally conductive to promote heat transfer, and can be electrically insulating or electrically conductive. If an electrically conductive material is used, then an insulating film is preferably deposited before applying the diamond film, to provide electrical insulation for supporting an electrical bias across the diamond film.

The electron mirror 114 is biased at a voltage $V_a$ as shown in FIG. 7C, that is, similarly to the biasing arrangement shown in FIG. 3. Electrons generated by the primary electron emitter 102 are repeatedly accelerated into the electron mirror 114 and urged by the potential $V_a$ toward the open end of the generally conical electron multiplier 110. It is anticipated that space charge forces of the emitted secondary electrons along with electrical potentials created by the biasing voltage $V_a$ will be sufficient to repeatedly drive secondary electrons back toward the electron mirror 114. Alternatively, a biasing electrode (not shown) can be inserted inside the generally conical electron multiplier 110 to provide additional accelerating force. Moreover, the electron mirror 114 is optionally divided into generally annular film dynodes analogously to the hollow beam electron source 12' of FIG. 5.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An electron source including:

a substantially conical electron multiplier having an apex region and an open output end; and a field emission electron emitter arranged to input electrons into the apex region of the substantially conical electron multiplier.

2. The electron source as set forth in claim 1, wherein the substantially conical electron multiplier defines a frustum of a cone, and the field emission electron emitter is arranged in a region defined by a missing apex portion of the conical frustum.

3. The electron source as set forth in claim 1, wherein the field emission electron emitter includes:

an array of field emissive diamond film elements.

4. The electron source as set forth in claim 3, wherein the array of field emissive diamond film elements is generally planar, and the field emission electron emitter further includes:

steering electrodes arranged in the plane of the generally planar array of field emissive diamond film elements, the steering electrodes biased to urge electrons emitted by the field emissive diamond film elements into the apex region of the electron multiplier.

5. An electron source including:

a substantially conical electron multiplier having an apex region and an open output end, the electron multiplier including a substantially conical substrate, an electron mirror including a high secondary electron yield film disposed on an outer surface of the substantially conical substrate, and an electrically insulating film disposed between the high secondary electron yield film and the substantially conical substrate; and an electron emitter arranged to input electrons into the apex region of the substantially conical electron multiplier.

6. The electron source as set forth in claim 5, wherein the substantially conical substrate includes:

an electrically conducting outer surface on which the insulating film is disposed.

7. An electron source including:

a substantially conical electron multiplier having an apex region and an open output end, the electron multiplier including a substantially conical substrate with an electron mirror including a high secondary electron yield film disposed thereon, and a substantially conical focusing electrode surrounding the substantially conical substrate; and an electron emitter arranged to input electrons into the apex region of the substantially conical electron multiplier.

8. The electron source as set forth in claim 7, wherein the substantially conical focusing electrode includes:

a first conical section generally surrounding the electron emitter, the first conical section biased to urge electrons toward the apex region of the substantially conical electron multiplier; and a second conical section generally surrounding the electron multiplier.

9. An electron source including:

a substantially conical electron multiplier having an apex region and an open output end, the electron multiplier including a substantially conical substrate and an electron mirror including a diamond film disposed on an outer surface of the substantially conical substrate; and an electron emitter arranged to input electrons into the apex region of the substantially conical electron multiplier.

10. The electron source as set forth in claim 9, wherein the substantially conical electron multiplier further includes:

a hollow substantially conical outer substrate surrounding the substantially conical substrate; and an outer electron mirror including a high secondary electron yield film disposed on an inner surface of the conical outer substrate.

11. An electron source including:

a substantially conical electron multiplier having an apex region and an open output end, the electron multiplier including a substantially conical substrate and an electron mirror including a high secondary electron yield film disposed on an outer surface of the substantially conical substrate, the high secondary electron yield film including a succession of generally annular film rings having increasing radius with distance from the apex region, the annular rings being more positively electrically biased with increasing distance from the apex region.

12. The electron source as set forth in claim 11, wherein the substantially conical electron multiplier further includes:

a hollow substantially conical outer substrate surrounding the substantially conical substrate; and an outer electron mirror including a high secondary electron yield film disposed on an inner surface of the conical outer substrate, the outer electron mirror including a succession of generally annular rings, the annular rings having increasing radius with distance from the apex region, the annular rings being more positively electrically biased with increasing distance from the apex region.

13. An electron source including:

a substantially conical electron multiplier having an apex region and an open output end, the substantially conical electron multiplier including a substantially conical substrate and an electron mirror including a high secondary electron yield film disposed over an inner surface of the conical substrate; and an electron emitter arranged to input electrons into the apex region of the substantially conical electron multiplier.

14. The electron source as set forth in claim 13, wherein the high secondary electron yield film includes:

a diamond film.

15. The electron source as set forth in claim 13, wherein the substantially conical substrate includes:

a plurality of joined substrate portions, each joined substrate portion having a surface oriented toward an interior of the substantially conical substrate that is coated with the high secondary electron yield material deposited thereupon by chemical vapor deposition.

16. The electron source as set forth in claim 13, wherein the electron mirror further includes:

an electrically insulating film disposed between the high secondary electron yield film and the substantially conical substrate.

17. The electron source as set forth in claim 16, wherein the substantially conical substrate includes:

an electrically conducting outer surface on which the insulating film is disposed.

18. The electron source as set forth in claim 16, wherein the high secondary electron yield film includes:

a plurality of annular film rings arranged at increasing distances from the apex region of the substantially conical electron multiplier, the annular rings having increasing radius with increasing distance from the apex, the annular rings being increasingly positively biased with increasing distance from the apex.

19. An electron source including:

a substantially conical electron multiplier having an apex region and an open output end, the electron multiplier including a first electron mirror defining a first substantially conical surface and a second electron mirror facing the first electron mirror, the second electron mirror defining a second substantially conical surface; and an electron emitter arranged to input electrons into the apex region of the substantially conical electron multiplier.

20. The electron source as set forth in claim 19, wherein the first and second electron mirrors each include:

a plurality of electrically isolated diamond layers that define a plurality of dynodes, the dynodes being increasingly positively biased with increased distance from the apex region.

* * * * *